United States Patent [19]

Jackisch et al.

[11] 4,116,644

[45] Sep. 26, 1978

[54] GASOLINE COMPOSITIONS

[76] Inventors: Philip F. Jackisch, 4218 Rosewold, Royal Oak, Mich. 48073; Calvin J. Worrel, 20075 Houghton, Detroit, Mich. 48219

[21] Appl. No.: 764,214

[22] Filed: Jan. 31, 1977

Related U.S. Application Data

[63] Continuation-in-part of Ser. No. 561,371, Mar. 24, 1975, abandoned.

[51] Int. Cl.[2] ..... C10L 1/24

[52] U.S. Cl. ..... 44/73; 44/58; 44/75

[58] Field of Search ..... 44/73, 75, 58, 78, 76, 44/66

[56] References Cited

U.S. PATENT DOCUMENTS

| | | | |
|---|---|---|---|
| 2,632,695 | 3/1953 | Landis et al. | 44/66 |
| 2,807,525 | 9/1957 | Foreman | 44/53 |
| 3,031,284 | 4/1962 | Andress, Jr. | 44/76 |
| 3,752,657 | 8/1973 | Manary, Jr. | 44/78 |
| 3,994,698 | 11/1976 | Worrel | 44/58 |

*Primary Examiner*—Winston A. Douglas
*Assistant Examiner*—Y. Harris-Smith
*Attorney, Agent, or Firm*—Donald L. Johnson; Robert A. Linn; Willard G. Montgomery

[57] ABSTRACT

Fuel induction systems of internal combustion engines are cleansed by operating the engine on a gasoline containing a detergent amount of the condensation product of phenol, and preferably a high molecular weight alkylphenol, an aldehyde, and an amine having a H—N< group. Effectiveness is improved, especially when using a large amount of the detergent composition or when using the detergent composition with water intolerant gasolines, by inclusion of a demulsifier containing an aryl sulfonate, a polyether glycol, and an oxyalkylated phenol formaldehyde resin.

The concentrates of this invention also include one or more alcohols of about 4 to about 10 carbon atoms, an aromatic solvent, and a corrosion inhibitor.

This invention also comprises gasolines containing these concentrates; the concentrate being present in a small amount that confers carburetor detergency properties to the gasoline.

6 Claims, No Drawings

GASOLINE COMPOSITIONS

CROSS REFERENCE TO RELATED APPLICATION

This application is a continuation-in-part of application Ser. No. 561,371, filed Mar. 24, 1975, now abandoned.

BACKGROUND OF THE INVENTION

Operation of an internal combustion engine over an extended period of time leads to the formation of deposits in the fuel induction system such as the carburetor and around the intake valves. These deposits interfere with the efficient operation of the engine and can lead to lower mileage and increased exhaust emission. It is known in the prior art, U.S. Pat. No. 3,649,229, Austrian Pat. No. 315,994, British Pat. No. 1,368,532, German Pat. No. 2,209,579, that the inclusion in gasoline of the condensation product of a high molecular weight alkylphenol, an aldehyde, and an amine having a H—H< group improves intake system cleanliness. However, when this detergent composition is used in gasoline in high concentrations or is added to water intolerant gasolines water/gasoline emulsion problems occur. It has been discovered that introducing a demulsifying composition comprising an aryl sulfonate, a polyether glycol, and an oxyalkylated phenol formaldehyde resin to gasolines containing the detergent composition remedies these water/gasoline emulsion problems. Preferred embodiments of this invention also contain a corrosion inhibitor and one or more lower alkanols of from about 4 to about 10 carbon atoms, and also an aromatic hydrocarbon solvent.

Blending of components to make a suitable concentrate to be used in gasoline composition is very difficult. The components must not only be used in amounts which confer the required properties on the gasoline concentrate, but the components must also be compatible with each other under use and storage conditions. Furthermore, some components used for different functions can be found to be mutually antagonistic such as mixtures of corrosion inhibitors and demulsifiers. When antagonism occurs, loss of desired function is a result.

This invention provides an economical carburetor detergency package eminently suitable for gasoline use. Although a number of components are admixed, compatibility of the components is excellent. Furthermore, there is a surprisingly low level of antagonism between the components.

SUMMARY OF THE INVENTION

This invention comprises:

Concentrate for use in liquid hydrocarbon fuel boiling in the gasoline boiling range containing (I) from about 35 to about 50 weight percent of the reaction product of:

(A) one mole part of an alkylphenol having the formula:

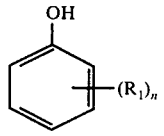

wherein $n$ is an integer from 1 to 2, and $R_1$ is an aliphatic hydrocarbon radical having an average molecular weight of from about 400 to 1500;

(B) from 1–5 mole parts of an aldehyde having the formula:

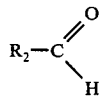

wherein $R_2$ is selected from hydrogen and alkyl radicals containing 1–6 carbon atoms; and (C) from 0.5–5 mole parts of an amine having at least one active hydrogen atom bonded to an amino nitrogen atom, and (II) from about 1.4 to about 5.6 weight percent of a demulsifying agent containing:

(A) at least one oil-soluble amine, ammonium, alkaline earth metal, or alkali metal salt of an aryl sulfonic acid;

(B) at least one oil-soluble polyether characterized by the presence within its structure of a group of the formula:

$$-O-A-_x$$

wherein A is an alkylene group containing from 2 to about 7 carbon atoms and where $x$ has an average value of from about 5 to about 200; and (C) an oxyalkylated phenol formaldehyde resin of the formula:

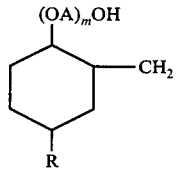

wherein A represents an alkylene group containing from about 2 to about 10 carbon atoms, where $m$ has an average value of from about 4 to about 200, and where R is an alkyl group of about from 1 to about 20 carbon atoms, (III) from about 20 to about 25 weight percent of a mononuclear or dinuclear aromatic hydrocarbon solvent, (IV) from about 20 to about 35 weight percent of an alkanol having from 4 to 10 carbon atoms, and (V) from about 3 to about 5 weight percent of a corrosion inhibitor.

In preferred embodiments, the alkanol is a mixture of alkanols having 4, 6, 8 and 10 carbon atoms, or is a mixture of $C_6$, $C_8$ and $C_{10}$ alcohols.

This invention also comprises gasolines containing such concentrates. Gasolines of this invention contain the concentrate in a small amount which is sufficient to confer carburetor detergency.

DESCRIPTION OF PREFERRED EMBODIMENTS

The detergents are made by condensing a phenol and preferably a high molecular weight alkylphenol, an aldehyde and ammonia or preferably an aliphatic amine having at least one reactive hydrogen atom bonded to nitrogen. In other words, an amine having at least one H—N< group. This reaction is the well-known "Mannich reaction" (see δOrganic Reactions," Volume I). The conditions for carrying out such a condensation are well known.

The preferred alkylphenol reactant is an alkylphenol wherein the alkyl radical has an average molecular weight of from about 400 to 1500. In a more preferred alkylphenol reactant the alkyl radical has an average molecular weight of from about 800 to 1300, and in the most preferred alkylphenols the alkyl radical has an average molecular weight of from about 900 to 1100.

Alkylphenols suitable for use in the preparation of the present dispersants are readily prepared by adaptation of methods well known in the art. For example, they may be prepared by the acid catalyzed alkylation of phenol with an olefin. In this method, a small amount of an acid catalyst such as sulfuric or phosphoric acid, or preferably a Lewis acid such as $BF_3$-etherate, $BF_3$-phenate complex or $AlCl_2$-$HSO_4$, is added to the phenol and the olefin then added to the phenol at temperatures ranging from about 0° C. up to 200° C. A preferred temperature range for this alkylation is from about 25° C. to 150° C., and the most preferred range is from about 50° C. to 100° C. The alkylation is readily carried out at atmospheric pressures, but if higher temperatures are employed the alkylation may be carried out at super atmospheric pressures up to about 1000 psig.

The alkylation of phenols produces a mixure of mono-, di- and tri-alkyklation phenols. Although the preferred reactants are the mono-alkylated phenols, the alkylation mixture can be used without removing the higher alkylation products. The alkylation mixture formed by alkylating phenol with an olefin using an acid catalyst can be merely water washed to remove the unalkylated phenol and the acid catalyst and then used in the condensation reaction without removing the di- and tri-alkylated phenol products. The di-alkylated phenol enters into the condensation reaction and yields useful gasoline detergents. Another method of removing the unreacted phenol is to distill it out, preferably using steam distillation or under vacuum, after washing out the alkylation catalyst. The maount of di- and tri-alkylated phenols can be kept at a minimum by restricting the amount of olefin reactant added to the phenol. Good results are obtained when the mole ratio of olefin to phenol is about 0.25 moles of olefin per mole of phenol to 1.0 mole of olefin per mole of phenol. A more preferred ratio is from about 0.33 to 0.9, and a most preferred ratio is from about 0.5 to 0.67 moles of olefin per mole of phenol.

The olefin reactant used to alkylate the phenol is preferably a monoolefin with an average molecular weight of from about 400 to 1500. The more preferred olefins are those formed from the polymerization of low molecular weight olefins containing from about 2 to 10 carbon atoms, such as ethylene, propylene, butylene, pentene and decene. These result in polyalkene substituted phenols. A most preferred olefin is that made by the polymerization of propylene or butene to produce a polypropylene or polybutene mixture with an average molecular weight of from about 900–1100. This gives the highly preferred polypropylene and polybutene substituted phenols.

The aldehyde reactant preferably contains from 1 to 7 carbon atoms. Examples are formaldehyde, acetaldehyde, propionaldehyde, butyraldehyde, valeraldehyde, hexaldehyde and heptaldehyde. The more preferred aldehyde reactants are the low molecular weight aliphatic aldehydes containing from 1 to about 4 carbon atoms such as formaldehyde, acetaldehyde, butyraldehyde and isobutyraldehyde. The most preferred aldehyde reactant is formaldehyde, which may be used in its monomeric or its polymeric form such as paraformaldehyde.

The amine reactants include those that contain at least one active hydrogen atom bonded to an amino nitrogen atom, such that they can partake in a Mannich condensation. They may be primary amines, secondary amines or may contain both primary and secondary amino groups. Examples include the primary alkyl amines such as methyl amine, ethyl amine, n-propyl amine, isopropyl amine, n-butyl amine, isobutyl amine, 2-ethylhexyl amine, dodecyl amine, stearyl amine, eicosyl amine, triacontyl amine, pentacontyl amine, and the like, including those in which the alkyl group contains from 1 to about 50 carbon atoms. Also, dialkyl amines may be used such as dimethyl amine, diethyl amine, methylethyl amine, methylbutyl amine, di-n-hexyl amine, methyl dodecyl amine, dieicosyl amine, methyl triacontyl amine, dipentacontyl amine, and the like, including mixtures thereof.

Another useful class is the N-substituted compounds such as the N-alkyl imidazolidines and pyrimidines. Also, aromatic amines having a reactive hydrogen atom attached to nitrogen can be used. These include aniline, N-methyl aniline, ortho, meta and para phenylene diamines, α-naphthyl amine, N-isopropyl phenylene diamine, and the like. Secondary heterocyclic amines are likewise useful including morpholine, thiomorpholine, pyrrole, pyrroline, pyrrolidine, indole, pyrazole, pyrazoline, pyrazolidine, imidazole, imidazoline, imidazolidine, piperidine, phenoxazine, phenathiazine, and mixtures thereof, including their substituted homologs in which the substituent groups include alkyl, aryl, alkaryl, aralkyl, cycloalkyl, and the like.

A preferred class of amine reactants is the diamines represented by the formula:

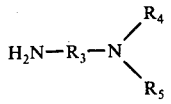

wherein $R_3$ is a divalent alkylene radical containing 1–6 carbon atoms, and $R_4$ and $R_5$ are selected from the group consisting of alkyl radicals containing from 1–6 carbon atoms and radicals having the formula:

$$-R_6-X$$

wherein $R_6$ is a divalent alkylene radical containing from 1–6 carbon atoms, and X is selected from the group consisting of the hydroxyl radical and the amine radical.

The term "divalent alkylene radical" as used herein means a divalent saturated aliphatic hydrocarbon radical having the empirical formula:

$$-C_nH_{2n}-$$

wherein $n$ is an integer from 1 to about 6. Preferably, $R_3$ is a lower alkylene radical such as the $-C_2H_4-$, $-C_3H_6-$, or $-C_4H_6-$ groups. The two amine groups may be bonded to the same or different carbon atoms. Some examples of diamine reactants wherein the amine groups are attached to the same carbon atoms of the alkylene radical $R_3$ are N,N-dialkyl-methylenediamine, N,N-dialkanol-1,3-ethanediamine, and N,N-di(aminoalkyl)-2,2-propanediamine.

Some examples of diamine reactants in which the amine groups are bonded to adjacent carbon atoms of the $R_3$ alkylene radical are N,N-dialkyl-1,2-ethanediamine, N,N-dialkanol-1,2-propanediamine, N,N-di(aminoalkyl)-2,3-butanediamine, and N,N-dialkyl-2,3-(4-methylpentane)diamine.

Some examples of diamine reactants in which the amine groups are bonded to carbon atoms on the alkylene radical represented by $R_3$ which are removed from each other by one or more intervening carbon atoms are N,N-dialkyl-1,3-propanediamine, N,N-dialkanol-1,3-butanediamine, N,N-di(aminoalkyl)-1,4-butanediamine, and N,N-dialkyl-1,3hexanediamine.

As previously stated, $R_4$ and $R_5$ are alkyl radicals containing 1 to 6 carbon atoms or alkyl radicals containing 1 to 6 carbon atoms which are substituted with the hydroxyl or amine radical. Some examples of hydroxyl substituted radicals are 2-hydroxy-n-propyl, 2-hydroxyethyl, 2-hydroxy-n-hexyl, 3-hydroxy-n-propyl, 4-hydroxy-3-ethyl-n-butyl, and the like. Some examples of amine substituted $R_4$ and $R_5$ radicals are 2-aminoethyl, 2-amino-n-propyl, 4-amino-n-butyl, 4-amino-3,3-dimethyl-n-butyl, 6-amino-n-hexyl, and the like. Preferred $R_4$ and $R_5$ radicals are unsubstituted alkyl radicals such as methyl, ethyl, n-propyl, isopropyl, sec-butyl, n-amyl, n-hexyl, 2-methyl-n-pentyl, and the like. The most preferred $R_4$ and $R_5$ substituents are methyl radicals.

Some specific examples of diamine reactants are N,N-dimethyl-1,3-propanediamine, N,N-dibutyl-1,3-propanediamine, N,N-dihexyl-1,3-propanediamine, N,N-dimethyl-1,2-propanediamine, N.N-dimethyl-1,1-propanediamine, N,N-dimethyl-1,3-hexanediamine, N,N-dimethyl-1,3-butanediamine, N,N-di(2hydroxyethyl)-1,3-propanediamine, N,N-di(2-hydroxybutyl)-1,3-propanediamine, N,N-di(6-hydroxyhexyl)-1,1-hexanediamine, N,N-di(2-aminoethyl)-1,3-propanediamine, N,N-di(2-amino-n-hexyl)-1,2-butanediamine, N,N-di(4-amino-3,3-di-methyl-n-butyl)-4-methyl-1,3-pentanediamine, and N-(2-hydroxyethyl)-N-(2-aminoethyl)-1,3-propanediamine.

Another very useful class of amine reactants is the alkylene polyamines which have the formula:

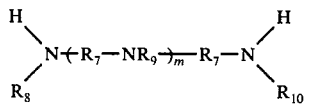

wherein $R_8$, $R_9$ and $R_{10}$ are selected from hydrogen and lower alkyl rdicals containing 1–4 carbon atoms, and $R_7$ is a divalent saturated aliphatic hydrocarbon radical containing from 2 to about 4 carbon atoms and *m* is an integer from 0 to about 4. Examples of these are ethylene diamine, diethylene triamine, propylene diamine, dipropylene triamine, tripropylene tetraamine, tetrapropylene pentamine, butylene diamine, dibutylene triamine, diisobutylene triamine, tributylene tetramine, and the like, including the N.$C_{1-4}$ alkyl-substituted homologs.

A most preferred class of amine reactants is the ethylene polyamines. These are described in detail in Kirk-Othmer, "Encyclopedia of Chemical Technology," Vol. 5, pages 898–9, Interscience Publishers, Inc., New York. These include the series ethylene diamine, diethylene triamine, triethylene tetramine, tetraethylene pentamine, pentaethylene hexamine, and the like. A particularly preferred embodiment is a gasoline containing the detergent as described herein in which the amine reactant is a mixture of ethylene polyamines containing a substantial amount of triethylene tetramine and tetraethylene pentamine.

The condensation products are easily prepared by mixing together the alkylphenol, the aldehyde reactant and the amine reactant, and heating them to a temperature sufficient to cause the reaction to occur. The reaction may be carried out without any solvent, but the use of a solvent is usually preferred. Preferred solvents are the water immiscible solvents including water-insoluble alcohols (e.g., amyl alcohol) and hydrocarbons. The more preferred water-immiscible solvents are hydrocarbon solvents boiling from 50° C. to about 100° C. Highly preferred solvents are the aromatic hydrocarbon solvents such as benzene, toluene, xylene, and the like. Of these, the most preferred solvent is toluene. The amount of solvent employed is not critical. Good results are obtained when from one to about 50 percent of the reaction mass is solvent. A more preferred quantity is from 3 to about 25 percent, and a most preferred quantity of solvent is from about 5 to 10 percent.

The ratio of reactants per mole of alkylphenol can vary from about 1 to 5 moles of aldehyde reactant and 0.5–5 moles of amine reactant. Molar amounts of amine less than one can be used when the amine contains more than one H—N< group, such as in the ethylene polyamines (e.g., tetraethylenepentamine). A more preferred reactant ratio based on one mole of alkylphenol is from 2.5 to 4 moles of aldehyde and from 1.5 to 2.5 moles of amine reactant. A most preferred ratio of reactants is about 2 moles of alkylphenol to about 3 moles of aldehyde to about 2 moles of amine reactant. This ratio gives an especially useful product when the alkylphenol is a polybutene-substituted phenol in which the polybutene group has a molecular weight of about 900–1100, the aldehyde is formaldehyde and the amine is N,N-dimethyl-1,3-propanediamine.

The condensation reaction will occur by simply warming the reactant mixture to a temperature sufficient to effect the reaction. The reaction will proceed at temperatures ranging from about 50° C. to 200° C. A more preferred temperature range is from about 75° C. to 175° C. When a solvent is employed it is desirable to conduct the reaction at the reflux temperature of the solvent-containing reaction mass. For example, when toluene is used as the solvent, the condensation proceeds at about 100° C. to 150° C. as the water formed in the reaction is removed. The water formed in the reaction co-distills together with the water-immiscible solvent, permitting its removal from the reaction zone. During this water removal portion of the reaction period the water-immiscible solvent is returned to the reaction zone after separating water from it.

The time required to complete the reaction depends upon the reactants employed and the reaction temperature used. Under most conditions the reaction is complete in from about one to 8 hours.

The reaction product is a viscous oil and is usually diluted with a neutral oil to aid in handling. A particularly useful mixture is about two-thirds condensation product and one-third neutral oil.

It has been found that there are two situations when the use of the aforedescribed condensation product presents certain problems. The first of these two situations arises when said condensation product is added to gasoline in high concentrations, i.e., concentrations above about 100 ppm. The second situation arises when said condensation product is used with water intolerant gasolines, i.e., gasolines which when contacted with water tend to degrade or form an emulsion. In both of these situtions water/gasoline emulsion problems occur.

In the prior art workers have added demulsifiers to gasolines to remedy emulsion problems.

It has now been discovered that a specific three component demulsifying composition, when used in combination with the condensation product solves these gasoline-water emulsion problems. The first component of the preferred demulsifying composition is an oil-soluble amine, ammonium, or alkali metal salt of a sulfonic acid, i.e., alkyl or aryl sulfonate. These salts are prepared through conventional techniques by neutralizing oil-soluble aryl or alkyl sulfonic acids with an amine, ammonia, an alkali metal base, or mixtures thereof. The alkyl sulfonates are prepared by neutralizing oil-soluble sulfonic acids of the general formula $R'\text{-}(SO_3H)_a$. The groupR' in this formula is an aliphtic or aliphatic-substituted cycloaliphatic radical. Where R' is an aliphatic radical, it should contain from about 15 to about 18 carbon atoms. Where R' is an aliphatic-substituted cycloaliphatic group, the aliphatic substituents should contain a total of at least about 12 carbon atoms. Examples of R' are alkyl, alkenyl, and alkoxyalkyl radicals and aliphatic-substituted cycloaliphatic radicals wherein the aliphatic substituents are alkoxy, alkoxyalkyl, carboalkoxyalkyl, and the like. Generally, the cycloaliphatic radical will be a cycloalkane nucleus or a cycloalkene nucleus such as cyclopentane, cyclohexene, cyclopentene, and the like. Some non-limiting specific examples of R' are cetylcyclohexyl, laurylcyclohexyl, and octadecenyl radicals, and radicals derived from petroleum, saturated and unsaturated paraffin wax, and polyolefins.

The more preferred salts of sulfonic acids are the aryl sulfonates. The aryl sulfonates are preferably oil-soluble amine, ammonium or alkali metal salts of aryl sulfonic acids. These salts are prepared through conventional techniques by neutralizing oil-soluble aryl sulfonic acids of the general formula $R_x\text{—}Z(SO_3H)_y$ with an amine, ammonia, or an alkali metal base. In the above formula Z is an aromatic nucleus of the mono- or polynuclear type including benzenoid or heterocyclic such as benzene, naphthalene, anthracene, 1,2,3,4-tetrahydro nephthalene, thianthrene, and the like. Ordinarily, however, Z will be an aromatic hydrocarbon nucleus, especially a benzene or naphthalene nucleus. The group R is most preferably an aliphatic group such as alkyl, alkenyl, alkoxy, alkoxyalkyl, carboalkoxyalkyl, or an aralkyl group and $x$ is at least one with the proviso that the radicals represented by R are such that the ammonium, amine, and alkaline earth metal salts prepared from such acids are oil-soluble. Groups represented by R should contain at least about eight aliphatic carbon atoms per sulfonic acid molecule and preferably at least about 21 aliphatic carbon atoms. Generally $x$ will be an integer of 1-3.

The groups Z and R can also contain other substituents such as hydroxy, mercapto, halogen, nitro, amino, nitroso, carboxy, alkoxy and the like, so long as the salts prepared from such substituent containing sulfonic acids are oil-soluble.

Illustrative examples of such sulfonic acids are mono- and polywax-substituted naphthalene sulfonic acids, cetylchlorobenzene, sulfonic acids, cetylphenol sulfonic acids, cetylphenol disulfide sulfonic acids, cetyloxycapryl benzene sulfonic acids, dicetyl thianthrene sulfonic acids, di-lauryl beta-naphthol sulfonic acids and dicapryl nitronaphthylene sulfonic acids.

The ammonium, amine, and alkali earth metal salts of the foregoing sulfonic acids are either known in the art or can be prepared according to conventional techniques, that is, by simply neutralizing the sulfonic acids with ammonia, the desired amine, or the desired alkali earth metal base.

Amines suitable for neutralizing the sulfonic acids include the primary, secondary, and tertiary amines including mono- and polyamino aliphatic amines, cycloaliphatic amines, aromatic amines, and heterocyclic amines. Examples of suitable amines are methyl amine, ethyl amine, diethyl amine, triethyl amine, ethanol amine, diethanol amine, triethanol amine, propanol amine dipropanol amine, triethanol amine, butanol amine, dibutanol amine, propanol amine, tripropanol amine, ethylene diamine, diethylene triamine, trimethylene diamine, tripropylene tetramine, pyridine, piperazine, aniline, phenylene diamine, naphthalamine, cyclohexyl amine, cyclopentyl amine, and the like.

Examples of alkali metal bases suitable for neutralizing the sulfonic acids include NaOH, $NaCO_3$, KOH, $KCO_3$, LiOH, $LiCO_3$ and the like.

The second essential component of the demulsifying composition is a polyether. By polyether is meant that class of oil-soluble materials characterized by the presence within their structure of at least one group of the formula $\text{—O-A})_x$ wherein A is an alkylene group, said alkylene group being a straight or branched chain alkylene group containing from 2 to about 7 carbon atoms, and wherein $x$ has an average value of from about 5 and up to about 200. Such polyethers are generally prepared by reacting an active hydrogen containing compound such as alcohols, amines, phenols, phenolformaldehyde condensation products, carboxylic acids, carboxylic acid esters, and the like with one or more alkylene oxides. The alkylene oxides are of the general formula

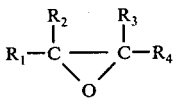

wherein $R_1$, $R_2$, $R_3$, and $R_4$ are each independently hydrogen, alkyl, cycloalkyl, alkenyl, aryl, and aralkyl groups. These hydrocarbon groups may contain such substituents as halo, nitro, alkoxy, and the like. The total number of carbon atoms in the alkylene oxide should not exceed 10 and should preferably be 2 to 4. Some non-limiting examples of these alkylene oxides are ethylene oxide, propylene oxide, 1,3-butylene oxide, epichlorohydrin, 1,2-octylene oxide, styrene oxide, and the like.

The preferred polyethers are polyoxyalkylene polyols and derivatives thereof. In addition to the polyols, the esters thereof obtained by reacting the polyols with various carboxylic acids are also suitable as the polyether component of the additive combination. Acids useful in preparing these esters are lauric acid, stearic acid, succinic acid, and the like.

The most preferred polyethers are the glycols of the general formula $H(OA)_nOH$ wherein (OA) represents mixed oxides, and A represents an alkylene group, said alkylene group being a straight or branched chain alkylene group containing from 2 to about 7 carbon atoms, and wherein *n* has an average value of from about 5 up to about 200.

One class of particularly useful liquid glycols have the general formula $$HO-(CH_2CH_2O)_x(\underset{\underset{CH_3}{|}}{C}HCH_2O)_y(CH_2CH_2O)_z-H$$

wherein *x, y,* and *z* are integers greater than one such that the $CH_2CH_2O$ groups comprise from about 10 percent to about 40 percent by weight of the polyether, the average molecule weight of said polyether being from about 1000 to about 5000.

The third essential component of the demulsifier composition is an oxylakylated phenol formaldehyde resin of the formula

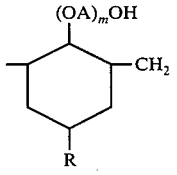

wherein (OA) in general represents mixed oxides and A represents an alkylene group, said alkylene group being either a straight or branched chain alkylene group containing from about 2 to about 10 carbon atoms; m has an average value of from about 4 up to about 200, and R is an alkyl or mixed alkyl group of from one to about 20 carbon atoms.

In general, to form the demulsifying composition of the present invention, the above three components, i.e., aryl sulfonate, polyglycol, and oxyalkylated phenol formaldehyde resin are mixed together in suitable ratio, usually in the presence of an inert organic diluent. Thus, for example, a suitable demulsifying composition can contain from about 2 to about 10 parts by weight of aryl sulfonate, from about 0.25 to about 4 parts by weight of polyether glycol, and from about 0.25 to about 4 parts by weight of oxyalkylated phenol formaldehyde resin. A more preferred demulsifying composition can contain from about 4 to about 8 parts by weight of aryl sulfonate, from about 0.5 to about 2 parts by weight of polyether glycol, and from about 0.5 to about 2 parts by weight of oxyalkylated phenol formaldehyde resin. A most preferred demulsifying composition contains about 6 parts by weight of aryl sulfonate, about one part by weight of glycol, and about one part by weight of oxyalkylated phenol formaldehyde resin. A most preferred demulsifying composition contains by weight, about 48 percent aryl sulfonate, about 8 percent glycol, about 8 percent oxyalkylated phenol formaldehyde resin and about 35 percent aromatic solvents.

It has been found that upon adding the detergent composition of the present invention, i.e., the phenol/aldehyde/amine product, to the demulsifying composition, these two compositions are not entirely compatible in that upon standing a sludge tends to develop. This problem of sludge formation can be rectified by the addition to the detergent/demulsifier composition of certain organic solvents described below.

Useful organic solvents are alkanols having 4-10 carbon atoms. These alkanols may be individual alkanols such as n-hexanol, heptanol, dodecanol, 2-ethylhexanol, cyclohexanol and the like or a mixture of such alkanols. Normal monoalkanols are preferred. An especially useful alkanol is a mixture containing $C_6$, $C_8$ and $C_{10}$ normal alkanols in a weight ratio of about 1:2:2 respectively. A further useful alkanol is a $C_4$ alkanol. Normal butanol is preferred; it is especially useful when admixed with the aforementioned mixture of $C_6$, $c_8$ and $C_{10}$ alkanols.

Another useful class of organic solvents are the aromatic hydrocarbons. The preferred aromatic hydrocarbons are the mononuclear or polynuclear aromatics such as the benzenes and naphthalenes. The more preferred aromatic hydrocarbons are the alkyl substituted aromatics. The most preferred aromatics are the lower alkyl substituted naphthalenes and benzenes such as xylene, toluene, 1,3,3-trimethylbenzene, 1,2,4-trimethylbenzene, 1,2,3-trimethylbenzene, 1,3,5-triethylbenzene, 1,2,4-triethylbenzene, 1-ethyl,-2-methylbenzene, 1-ethyl,3-methylbenzene, 1-ethyl,4-methylbenzene, pentamethylbenzene and the like. The aromatic solvent may be individual aromatic hydrocarbons or mixtures of such aromatic hydrocarbons.

A preferred solvent system consists of aromatic hydrocarbons. A more preferred solvent system is a mixture of (1) $C_6$, $C_8$, $C_{10}$-alkanols and (2) aromatic hydrocarbons. A most preferred solvent system is a mixture of (1) $C_6$, $C_8$, $C_{10}$-alkanols, (2) aromatic hydrocarbons and (3) $C_4$ alkanol.

These concentrates also contain corrosion inhibitors. Common anticorrosion additives for gasolines are generally surface active agents. Examples of useful corrosion inhibitors are long chain fatty acids, long chain amines and their simple salts, quaternary salts of long chain amines, metal salts of high molecular weight organic sulfonates and nonionic surfactants such as polyvinyl alcohol and condensates of ethylene oxides and high molecular weight amines. Some non-limiting examples of specific corrosion inhibiting materials are oleic acid dimer; bis(1,2-alkylamino)-2-propanol or phosphorylated bis(1,3-alkylamino-2-propanol such as N-dodecyl-1,3-diaminopropane, N-tridecyl-1,3-diaminopropane, N-pentadecyl-1,3-diaminopropane, N-heptadecyl-1,3-diaminopropane, N-nonadecyl-1,3-diaminopropane, N-eicosyl-1,3-diaminopropane, N-docosyl-1,3-diaminopropane, N-tricosyl-1,3-diaminopropane, N-pentacosyl-1,3-diaminopropane; nitronitritoalkane, alkylene polyamine and sulfur reaction products as described in U.S. Pat. No. 3,740,387; polycarboxylic acid having 7 to 44 carbon atoms and 2 or 3 carboxyl groups or a partial ester of the acid with an aliphatic alcohol having one to 18 carbon atoms, and an aliphatic tertiary amine having three hydrocarbon groups, each of which has at least one to 20 carbon atoms and at least one of which has 6 to 20 carbon atoms as described in U.S. Pat. No. 3,729,615; a concentrate of tertiary amine oxides, liquid aromatic hydrocarbons, and aliphatic monohydric or dihydric alcohols of from 6 to 13 carbon atoms as described in U.S. Pat. No. 3,594,130; 2-hydroxy-5-cetylbenzene-1,3-dicarboxylic acid; calcium naphtha sulfonate; phosphoric esters; tetrachlorophthalic acid; a mixture of carboxylic acids and phenol-aldehyde resins as described in U.S Pat. No. 3,658,707; alkyl sulfoxides as described in U.S. Pat. No. 3,591,354; and mercapto-substituted thiadiazoles as described in U.S. Pat. No. 3,663,561.

Preferred corrosion inhibitors are dimers of a comparatively long chain fatty acid, e.g. containing from 8 to 20 carbon atoms. Alternatively, and preferably, the material sold commercially and known as "dimer acid" may be used by itself or admixed with solvent. Dimer acid is prepared by dimerizing unsaturated fatty acid and is a mixture comprising monomer, dimer and trimer of this acid. A particularly preferred dimer acid is the dimer of linoleic acid available commercially under such trade names as Empol 1022.

Thus, a preferred additive package contains besides a corrosion inhibitor, (1) phenol/aldehyde/amine reaction product, (2) the three component demulsifier, and (3) aromatic hydrocarbon solvent. A more preferred additive package contains (1) phenol/aldehyde/amine reaction product (2) the three component demulsifier, (3) aromatic hydrocarbon solvent, (4) $C_6$, $C_8$. $C_{10}$ alkanol solvent. A most preferred additive package contains (1) phenol/aldehyde/amine reaction product, (2) the three component demulsifier, (3) aromatic hydrocarbon solvent, (4) $C_6$, $C_8$ $C_{10}$-alkanol solvent, and $C_4$ alkanol solvent.

A useful concentrate package contains, by weight percent, from about 1 percent to about 70 percent of the phenol/aldehyde/amine condensation product, from about 5 percent to about 50 percent of the aromatic hydrocarbon, from about 0.5 percent to about 75 percent of $C_6$, $C_8$, $C_{10}$-alkanol, from about 0.5 percent to about 30 percent of $C_4$ alkanol, and from about 0.5% to about 20 percent of the demulsifying agent. A preferred concentrate package contains, by weight, from about 20 percent to about 60 percent of the phenol/aldehyde/amine condensation product, from about 10 percent to about 40 percent of aromatic hydrocarbon, from about 5 percent to about 50 percent of $C_6$, $C_8$, $C_{10}$-alkanol, from about 1 percent to about 20 percent of $C_4$ alkanol, and from about 1 percent to about 10 percent of the demulsifier. A more preferred composition is one which contains, in percent by weight, from about 30 percent to about 50 percent of the phenol/aldehyde/amine condensation product, from about 18 percent to about 35 percent of aromatic hydrocarbons, from about 10 percent to about 40 percent of $C_6$, $C_8$, $C_{10}$-alkanol, from about 5 percent to about 15 percent of $C_4$ alkanol, and from about 1.4 percent to about 8 percent of the demulsifier.

The condentrate package also contains from about 1 percent to about 10 percent, preferably from about 2 percent to about 8 percent and most preferably from about 3 percent to about 4 percent of the corrosion inhibitor.

A still more preferred composition is one which contains, in percent by weight, from about 35 percent to about 50 percent of the phenol/aldehyde/amine condensation product, from about 20 percent to about 25 percent of aromatic hydrocarbons, from about 20 percent to about 35 percent of $C_4$, $C_6$, $C_8$, $C_{10}$-alkanol, and from about 1.4 percent to about 5.6 percent of the demulsifier, and from about 3 percent to about 4 percent of the corrosion inhibitor.

A most preferred concentrate gasoline additive package contains, by weight percent, about 38 percent of the phenol/aldehyde/amine condensation product, abot 21.4 percent of aromatic hydrocarbon, about 21.4 percent of $C_6$, $C_8$, $C_{10}$-alkanol, about 9.9 percent of $C_4$ alkanol, about 5.6 percent of the demulsifier and about 3.7 percent of the corrosion inhibitor, preferably the oleic acid dimer. This concentrate additive package is referred to below as type E concentrate.

Another most preferred concentrate is the same as above except the 9.9 percent of $C_4$ alkanol is replaced with the same weight percentage of $C_6$ alkanol.

The aforementioned type E concentrate was tested in five different gasolines using the ASTM D 1094 test. The test was conducted with both distilled water and with a pH 7 buffer, at both 35 and 700 ppm concentrations of type E concentrate in gasolines. The results of the tests are set forth in Table I below.

TABLE I

| Water Tolerance Test | | ASTM D 1094 Interface Ratings in Fuels | | | |
|---|---|---|---|---|---|
| Conc. (ppm) or Concentrate E | Indolene | Premium Base Fuel (unleaded) | Premium Fuel (leaded) | Water Tolerance Test Fuel | Regular Fuel (leaded) |
| 35 | 1,* 1** | 1,1 | 1,1 | 1,1 | 1,1 |
| 700 | 1, 1 | 1,1 | 1,1 | 1,1 | 1,1 |

*The first number of the rating refers to distilled water.
**The second number of the rating refers to pH 7 buffer.
Note
1 = clean interface, no bubbles.
1b = clean interface, no more than 50 percent monolayer of bubbles.
2 = 100 percent monolayer of bubbles.
3 = emulsion, heavy layer of bubbles, and/or scum.
4 = tight lace or heavy scum, or both.

Thus, it can be seen from Table I that when concentrate package E was tested in five different fuels a perfect "1" rating was obtained in all cases.

Table II which follows shows the results obtained in the ASTM D 1094 test when a different demulsifying agent was used in combination with the phenol/aldehyde/amine product. Concentrate package F contains 40 parts, by weight, of the phenol/aldehyde/amine condensation product, and 1.2 parts by weight of a demulsifier produced by Nalco Chemical Co., of Houston, Texas, under the designation VX-138.

TABLE II

| Conc. (ppm) or Concentrate F | Indolene | Premium Base Fuel (unleaded) | Premium Fuel (leaded) | Water Tolerance Test Fuel |
|---|---|---|---|---|
| 415 | 1b, 1b | 1b, 2 | 4, 3 | 3, 4 |

Table III shows the results obtained in the ASTM D 1094 test using a control group, that is, gasolines to which was added only the phenol/aldehyde/amine condensation product (without any demulsifying agent).

TABLE III

| Conc. (ppm) of phenol/aldehyde/amine condensation product without any demulsifier added | Indolene | Premium Base Fuel (unleaded) |
|---|---|---|
| 400 | 4, 3 | 4, 3 |

It can be seen from a comparison of Tables I, II, and III that concentrate E, which contains the three component demulsifying agent of the present invention, is superior to other concentrates without said demulsifying agent and greatly superior to a concentrate without any demulsifying agent. This improvement in gasoline compatibility of concentrate package E is achieved without any loss of the carburetor detergency efficiency of said concentrate.

The additives of this invention can be added directly to gasoline or they can be added in the form of the afore described concentrate package. Thus, another embodiment of the invention is a gasoline containing an additive amount of the detergent and the demulsifier.

In another preferred embodiment a synthetic olefin oligomer is used with the condensation product. These oligomers are prepared by the polymerization of aliphatic monoolefinic hydrocarbons such as ethylene, propylene, butene, decene-1, and the like. These result in such adjuvants as polyethylene, polypropylene, polybutene, α-decene trimer, α-decene tetramer and mixtures of the proper average molecular weight.

A particularly preferred polyolefin adjuvant is polybutene. Means of carrying out the polymerization of the simple olefin monomers are well known.

The polymerization should be carried out until the olefin forms a normally liquid oligomer having an average molecular weight of from about 300 to 2,000, especially 350-1500. The oligomers of this molecular weight range have the greatest effect in promoting the cleaning of intake valves when used in combination with a detergent of this invention. Additional polyolefins that may be used in the present invention and methods for their preparation are set forth in U.S. Pat. No. 3,948,619 Worrell, incorporated herein by reference, beginning at column 11, line 23 and continuing through column 19, line 17.

Gasoline compositions of this invention can be prepared by merely adding the detergent, with or without the polyolefin, and demulsifier in the proper amount to the gasoline base stock and stirring until dissolved. Likewise, the detergent can be injected into the gasoline stream in an in-line blending system either alone or in combination with other additives such as tetraalkyllead antiknocks.

As mentioned earlier, the amount of detergent added to the fuel is generally in the range of from about 3-2000 ppm; preferably from about 3-1000 ppm; more preferably from about 6-100 ppm; and most preferably from about 12-50 ppm. The amount of the demulsifier added to the gasoline is dependent, to a degree, upon the concentration of the detergent in the gasoline. Generally, from about 0.02-0.25 ppm of demulsifier are added for every one ppm of detergent; preferably 0.05-0.20 ppm of demulsifier are added for every one ppm of detergent, more preferably 0.1-0.18 ppm of demulsifier are added for every one ppm of gasoline; and most preferably from about 0.13-0.16 ppm of demulsifier are added for every one ppm of detergent.

Useful gasoline compositions containing the detergent and the demulsifier of the present invention are set forth below.

| Components (in ppm) | |
|---|---|
| Detergent | Demulsifier |
| 10 | 0.2 |
| 20 | 0.4 |
| 20 | 0.7 |
| 20 | 1.0 |
| 20 | 1.7 |
| 20 | 3.0 |
| 44.3 | 1.4 |
| 44.3 | 5.0 |
| 44.3 | 6.5 |
| 44.3 | 6.7 |
| 266 | 40 |
| 380 | 57 |
| 1000 | 147 |

The gasolines of this invention are modern gasolines of current use. Such gasolines are described in U.S. Pat. No. 3,994,698, column 1, line 58 to column 4, line 30, which disclosure is incorporated by reference herein as if fully set forth.

We claim:

1. A concentrate for use in liquid hydrocarbon fuel boiling in the gasoline boiling range containing (I) from about 35 to about 50 weigh percent of the reaction product of:

(A) one mole part of an alkylphenol having the formula:

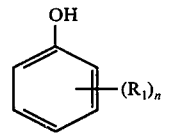

wherein $n$ is an integer from 1 to 2, and $R^1$ is an aliphatic hydrocarbon radical having an average molecular weight of from about 400 to 1500;

(B) from 1-5 mole parts of an aldehyde having the formula:

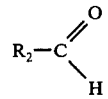

wherein $R_2$ is selected from hydrogen and alkyl radicals containing 1-6 carbon atoms; and (C) from 0.5-5 mole parts of an amine having at least one active hydrogen atom bonded to an amino nitrogen atom, and (II) from about 1.4 to about 5.6 weight percent of a demulsifying agent containing:

(A) at least one oil-soluble amine, ammonium, alkaline earth metal, or alkali metal salt of an aryl sulfonic acid;

(B) at least one oil-soluble polyether characterized by the presence within its structure of a group of the formula:

$$\text{-}(\text{O-A})_x\text{-}$$

wherein A is an alkylene group containing from 2 to about 7 carbon atoms and where $x$ has an average value of from about 5 to about 200; and (C) oxyalkylated phenol formaldehyde resin of the formula

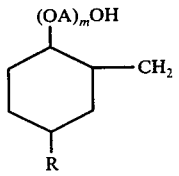

wherein A represents an alkylene group containing from about 2 to about 10 carbon atoms, where $m$ has an average value of from about 4 to about 200, and where R is an alkyl group of about from 1 to about 20 carbon atoms, (III) from about 20 to about 25 weight percent of a mononuclear or dinuclear aromatic hydrocarbon solvent, (IV) from about 20 to about 35 weight percent of an alkanol having from 4 to 10 carbon atoms, and (V) from about 3 to about 5 weight percent of a corrosion inhibitor.

2. A concentrate of claim 1 wherein said alkanol contains 4-10 carbon atoms.

3. A concentrate of claim 1 wherein said alkanol is a mixture of $C_6$-$C_{10}$ alcohols.

4. Gasoline containing a minor but carburetor detergency effective amount of a concentrate of claim 1.

5. Gasoline containing a minor but carburetor detergency effective amount of a concentrate of claim 2.

6. Gasoline containing a minor but carburetor detergency effective amount of a concentrate of claim 3.

* * * * *

UNITED STATES PATENT AND TRADEMARK OFFICE

CERTIFICATE OF CORRECTION

PATENT NO. : 4,116,644

DATED : September 26, 1978

INVENTOR(S) : Phillip F. Jackisch and Calvin J. Worrel

It is certified that error appears in the above-identified patent and that said Letters Patent are hereby corrected as shown below:

Column 3, Line 2, "(see& Organic Reactions," should read ---(see "Organic Reactions,"---

Column 3, Line 42, "The maount.." should read ---The amount---.

Column 5, Line 54, "rdicals" should read ---radicals---.

Column 8, Line 34, "$\text{———O-A)}_x$" should read---$\text{(———O-A———)}_x$---.

Column 10, Line 58, "U.S. Pat. No. 3,729,615" should read ---U.S. Pat. No. 3,720,615---.

Column 10, Line 61, "U.S. Pat. No. 3,594,130" should read ---U.S. Pat. No. 3,594,139---.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,116,644

DATED : September 26, 1978

INVENTOR(S) : PHILIP F. JACKISH and CALVIN J. WORREL

It is certified that error appears in the above-identified patent and that said Letters Patent is hereby corrected as shown below:

On the title page the following should be added:

--[73] Assignee: ETHYL CORPORATION, Richmond, Va. --.

Signed and Sealed this

Twenty-fourth Day of July 1984

[SEAL]

*Attest:*

GERALD J. MOSSINGHOFF

*Attesting Officer*

*Commissioner of Patents and Trademarks*